US010821590B2

(12) United States Patent
Hartmann et al.

(10) Patent No.: US 10,821,590 B2
(45) Date of Patent: Nov. 3, 2020

(54) STRIKING HAND-HELD MACHINE TOOL

(71) Applicant: Hilti Aktiengesellschaft, Schaan (LI)

(72) Inventors: Markus Hartmann, Mauerstetten (DE); Rory Britz, Buchloe (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 280 days.

(21) Appl. No.: 16/061,387

(22) PCT Filed: Dec. 6, 2016

(86) PCT No.: PCT/EP2016/079871

§ 371 (c)(1),
(2) Date: Jun. 12, 2018

(87) PCT Pub. No.: WO2017/102431

PCT Pub. Date: Jun. 22, 2017

(65) Prior Publication Data

US 2018/0361551 A1 Dec. 20, 2018

(30) Foreign Application Priority Data

Dec. 15, 2015 (EP) ..... 15200149

(51) Int. Cl.
*B25D 11/00* (2006.01)
*B25D 11/12* (2006.01)
*B25D 17/06* (2006.01)

(52) U.S. Cl.
CPC ..... *B25D 11/005* (2013.01); *B25D 11/125* (2013.01); *B25D 17/06* (2013.01);
(Continued)

(58) Field of Classification Search
CPC .... B25D 11/005; B25D 11/125; B25D 17/06; B25D 2217/0019; B25D 2250/035;
(Continued)

(56) References Cited

U.S. PATENT DOCUMENTS 5,111,890 A 5/1992 Ulrich et al.
6,116,352 A 9/2000 Frauhammer et al.
(Continued)

FOREIGN PATENT DOCUMENTS

DE 33 28 886 A1 2/1984
EP 1 607 187 A1 12/2005
(Continued)

OTHER PUBLICATIONS

International Bureau, International Search Report in International Application No. PCT/EP2016/079871, dated Feb. 23, 2017.

*Primary Examiner* — Michelle Lopez
(74) *Attorney, Agent, or Firm* — Leydig Voit & Mayer, Ltd.

(57) ABSTRACT

A hand-held machine tool for a striking tool has a motor, an impact mechanism, a spool valve, and a pneumatic chamber. The impact mechanism has an exciter piston moved by the motor, and a hammer coupled to the exciter piston via a pneumatic chamber between the exciter piston and the hammer, and a striker in front of the hammer in the striking direction. In a working position counter to the striking direction, the striker bears on a stop, in a starting position the striker is offset in the striking direction relative to the working position, and in a rest position the striker is offset in the striking direction relative to the starting position. In the starting position, the hammer bearing on the striker closes the spool valve and, in the rest position, the hammer bearing on the striker opens the spool valve.

16 Claims, 4 Drawing Sheets

(52) U.S. Cl.
CPC ..... *B25D 2217/0019* (2013.01); *B25D 2250/035* (2013.01); *B25D 2250/131* (2013.01); *B25D 2250/185* (2013.01); *B25D 2250/231* (2013.01); *B25D 2250/345* (2013.01); *B25D 2250/365* (2013.01)

(58) Field of Classification Search
CPC ..... B25D 2250/131; B25D 2250/185; B25D 2250/231; B25D 2250/345; B25D 2250/365
USPC ..... 173/200
See application file for complete search history.

(56) References Cited

U.S. PATENT DOCUMENTS

| | | | |
|---|---|---|---|
| 2002/0108766 | A1 | 8/2002 | Plank et al. |
| 2012/0024555 | A1 | 2/2012 | Sugiyama et al. |
| 2013/0284473 | A1 | 10/2013 | Hartmann et al. |
| 2016/0271779 | A1 | 9/2016 | Hartmann et al. |

FOREIGN PATENT DOCUMENTS

| | | | |
|---|---|---|---|
| EP | 2 653 270 | A2 | 10/2013 |
| NL | 7709910 | A | 3/1978 |
| WO | WO 2015/067590 | A1 | 5/2015 |
| WO | WO 2017/102418 | A1 | 6/2017 |
| WO | WO 2017/102429 | A1 | 6/2017 |
| WO | WO 2017/102437 | A1 | 6/2017 |

STRIKING HAND-HELD MACHINE TOOL

CROSS-REFERENCE TO RELATED APPLICATIONS

This patent application is the U.S. National Stage of International Patent Application No. PCT/EP2016/079871, filed Dec. 6, 2016, which claims the benefit of European Patent Application No. 15200149.1, filed Dec. 15, 2015, which are each incorporated by reference.

FIELD OF THE INVENTION

The present invention relates to a percussion power tool, in particular a hand-held pneumatic hammer drill and a hand-held pneumatic electric chisel.

BACKGROUND OF THE INVENTION

A hand-held pneumatic hammer drill comprises a pneumatic percussion mechanism, which is driven by a motor. A pneumatic chamber forms an air spring, which couples a percussion means to an exciter that is moved by the motor. The percussion mechanism is deactivated when the user does not apply any contact pressure to the tool in order to protect the percussion mechanism against excessive loading. As soon as the user presses the hammer drill against the tool, the percussion mechanism starts to work again. In high-powered machines, it has proven difficult to control the guidance of the hammer drill when pressing it against the tool again.

BRIEF SUMMARY OF THE INVENTION

The hand-held power tool according to the invention comprises a tool holder for holding a percussion tool on a working axis, an electric motor and a percussion mechanism. The percussion mechanism comprises an exciter that is moved by the electric motor, a percussion means, which is coupled to the exciter by means of a pneumatic chamber arranged between the exciter and the percussion means, and a rivet header that is arranged in front of the percussion means in the percussion direction. When in a working position, the rivet header rests against a stop counter to the percussion direction, when in a starting position, the rivet header is moved in the percussion direction into the working position, and, when in a resting position, the rivet header is moved in the percussion direction into the starting position.

A spool valve is formed by a first radial opening in the pneumatic chamber and the percussion means, the percussion means that is resting against the rivet header closing the spool valve when in the starting position, and the percussion means that is resting against the rivet header opening the spool valve when in the resting position. In the working position, a shut-off valve is closed in a manner actuated by the rivet header, and automatically opens in the starting position. A check valve is connected to the shut-off valve on the input side and is connected to the second radial opening in the pneumatic chamber on the output side.

In combination with the check valve, the exciter can increase the quantity of air in the pneumatic chamber. The higher quantity of air reduces the percussive power and increases the stiffness of the air spring, which makes it easier to position the tool on the substrate. During the chiseling operation, the rivet header deactivates the increase in the quantity of air by means of the shut-off valve arranged upstream of the check valve. During the chiseling operation, the increased quantity of air is targetedly reduced or targetedly reduces by means of loss channels, thereby increasing the percussive power to the threshold value. The percussion means can be completely switched off by means of the spool valve. The shut-off valve and the spool valve are controlled by the rivet header, and therefore indirectly by the user and by the tool being pressed against the substrate.

One embodiment contains a spool valve, which is formed by a radial opening in the pneumatic chamber and the percussion means. The spool valve is closed with respect to the pneumatic chamber by the percussion means that is resting against the rivet header that is in the working position the spool valve; and the spool valve is opened with respect to the pneumatic chamber by the percussion means, which is resting against the rivet header that is in front of the working position in the percussion direction. During a chiseling operation, the spool valve is completely closed and is only opened when the hand-held machine tool is in a resting position.

One embodiment provides that the shut-off valve comprises a resilient shut-off body, which, in a relaxed basic form, is at a spacing from a valve seat of the shut-off valve and is deformed so as to rest against the valve seat in a manner resiliently tensioned by the rivet header that is in the working position. The shut-off valve is directly actuated by the rivet header. The rivet header exerts a force that deforms the shut-off body or the user exerts the force by pressing the rivet header onto the tool.

One embodiment provides that the first channel opening is arranged on a percussion means-side reversal point of the exciter. The exciter preferably cannot seal the first channel opening. By means of its entire stroke, the exciter can suck air in via the check valve. The quantity of air can therefore be increased very rapidly to above the level that is normal during a chiseling operation.

One embodiment provides that the pneumatic chamber comprises a throttle opening for exchanging air between the pneumatic chamber and the area around the hand-held power tool. The throttle opening can be arranged on a percussion means-side reversal point of the exciter. A ratio of the cross-sectional area of the throttle opening to the cross-sectional area of the channel opening is preferably less than one to twelve. By means of the throttle opening, it is possible to targetedly adjust the flow of the increased quantity of air out of said opening. The throttle opening is very small, and therefore it preferably takes up to a second for the air to flow out.

One embodiment provides that the check valve is arranged at the first channel opening such that it cannot move. The check valve is preferably very close to the channel opening in order to minimize the dead volume in the channel portion between the channel opening and the check valve with respect to the average volume of the pneumatic chamber.

BRIEF DESCRIPTION OF THE SEVERAL VIEWS OF THE DRAWINGS

The following description explains the invention on the basis of example embodiments and drawings, in which.

Unless otherwise stated, elements that are the same or have the same function are indicated by the same reference signs in the figures.

DETAILED DESCRIPTION OF THE INVENTION

Figure 1:
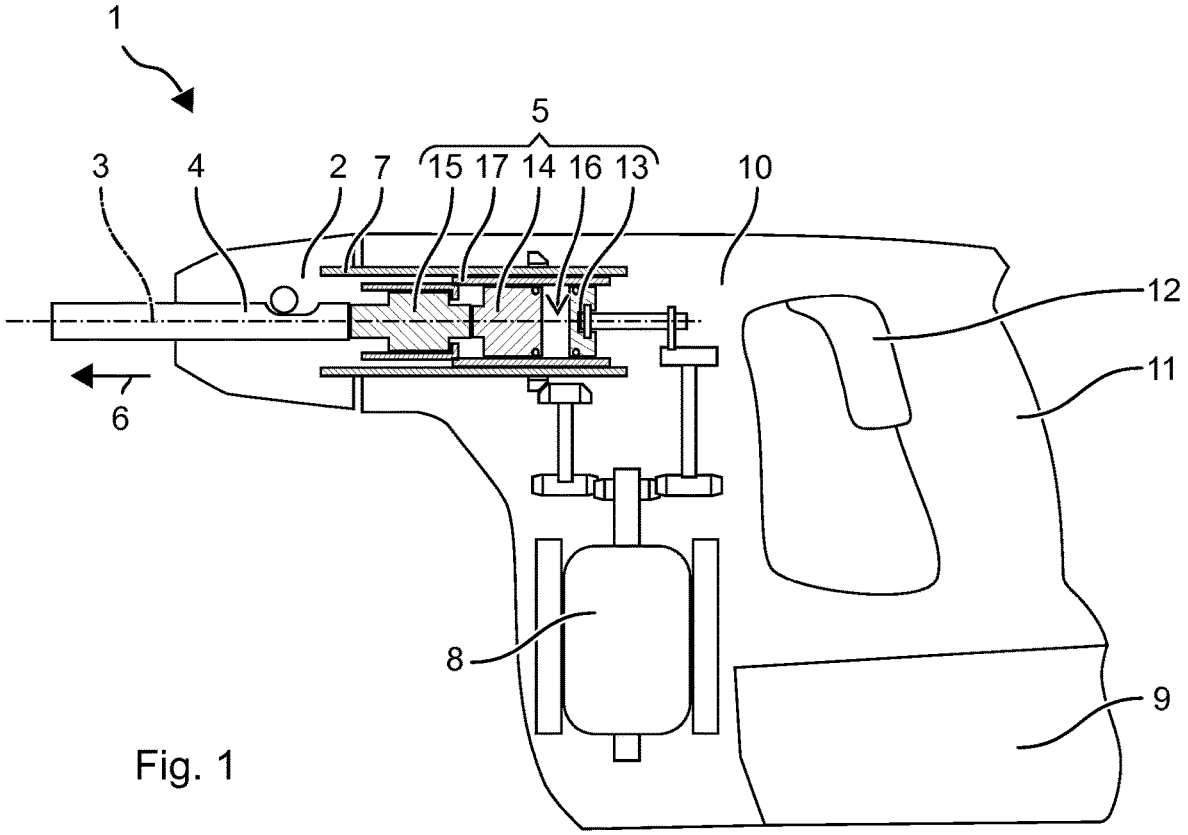
FIG. 1 shows a hammer drill.

FIG. 1 shows a hammer drill 1 as an example of a hand-held percussion power tool. The hammer drill 1 comprises a tool holder 2, in which a drill, chisel or other percussive tool 4 can be inserted and locked coaxially with a working axis 3. The hammer drill 1 comprises a pneumatic percussion mechanism 5, which can periodically strike the tool 4 in a percussion direction 6.

A rotary drive 7 can continuously rotate the tool holder 2 about the working axis 3. The pneumatic percussion mechanism 5 and the rotary drive are driven by an electric motor 8, which is supplied with electric current from a battery 9 or a mains power cable.

The percussion mechanism 5 and the rotary drive 7 are arranged in a machine housing 10. A handle 11 is typically arranged on a side of the machine housing 10 that faces away from the tool holder 2. The user can keep the hammer drill 1 running and guide it by means of the handle 11. An additional auxiliary handle can be attached near to the tool holder 2. An operating button 12 is arranged on or near the handle 11, which the user can operate, preferably using the hand holding the drill. The electric motor 8 is switched on by pressing the operating button 12. The electric motor 8 typically rotates for as long as the operating button 12 is pressed down and held.

Figure 2:
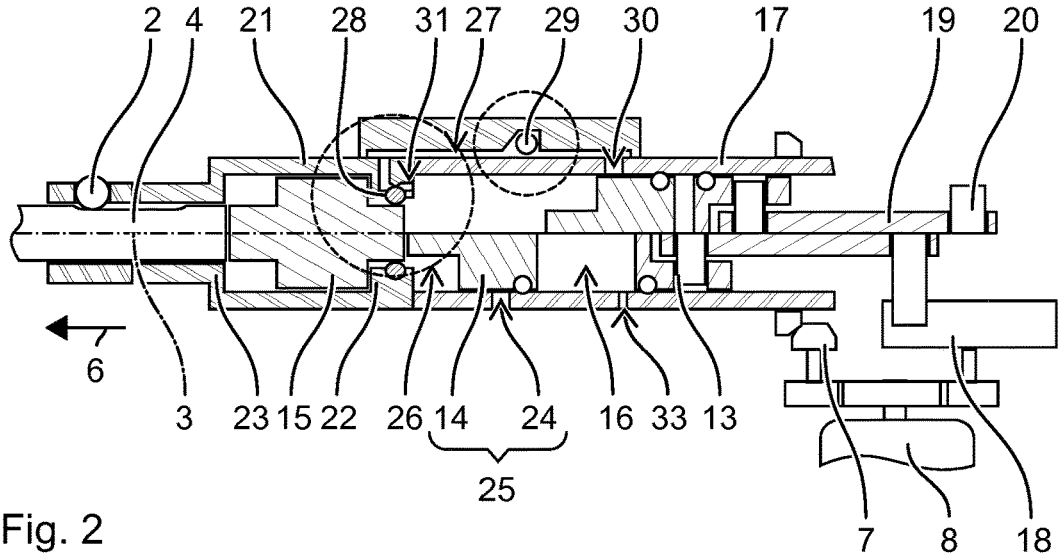
FIG. 2 shows the percussion mechanism in a chiseling phase.
Figure 3:
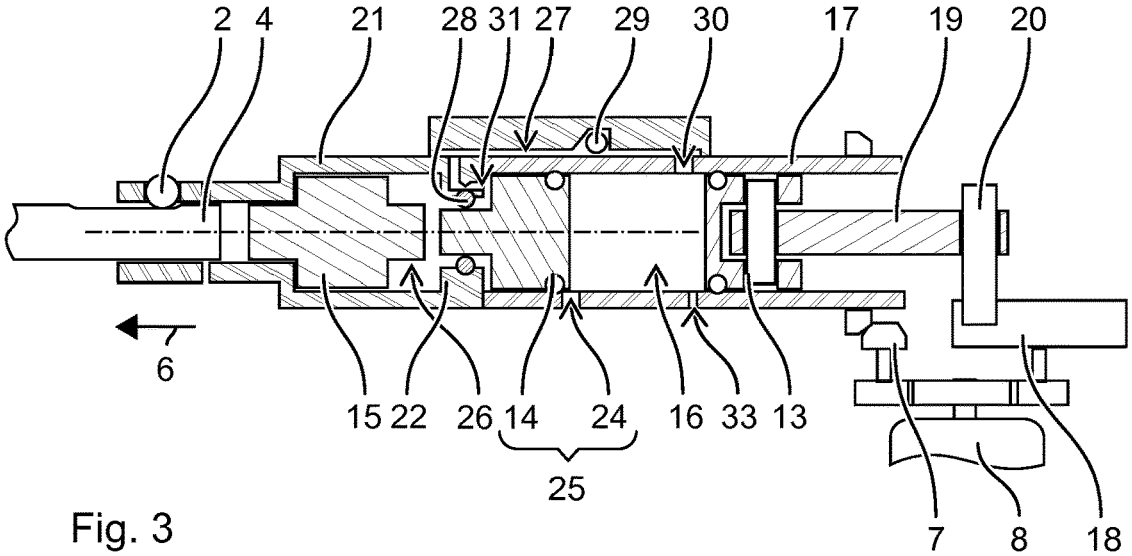
FIG. 3 shows the percussion mechanism in a resting phase.
Figure 4:
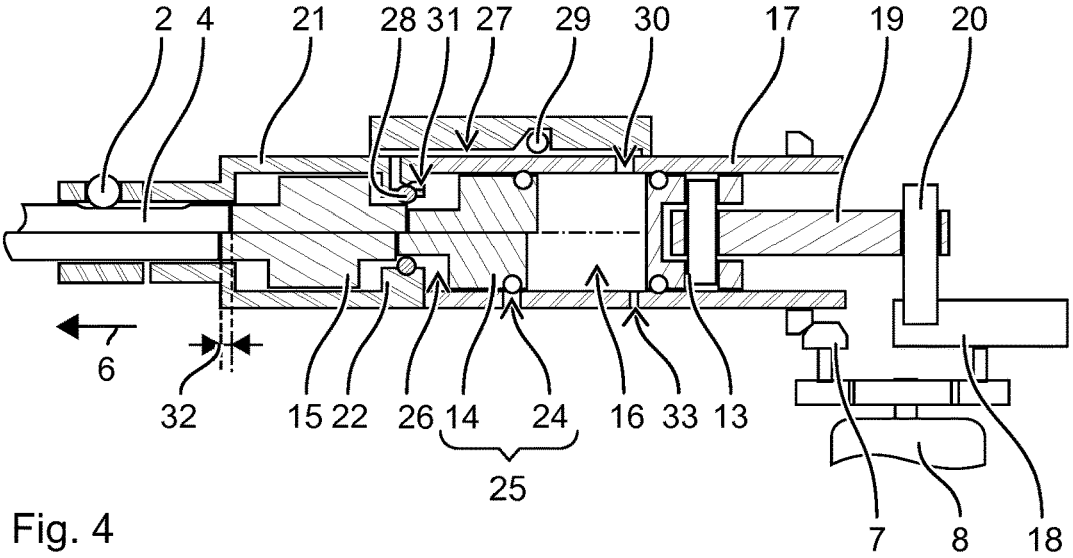
FIG. 4 shows the percussion mechanism in a starting phase.

The tool 4 can move in the tool holder 2 along the working axis 3. For example, the tool 4 comprises an elongate groove, in which a ball or a different shut-off body of the tool holder 2 engages. The user holds the tool 4 in a working position, whereby the user indirectly presses the tool 4 against a substrate by means of the hammer drill 1 (FIG. 2). Pressing the tool is associated with a chiseling phase. The tool 4 is moved out of the working position in the percussion direction 6 by the blow of the percussion mechanism 5. The tool 4 can remain in the advanced position if the user stops pressing on the hammer drill 1 (FIG. 3), this being associated with a resting phase and leading to the percussion mechanism 5 automatically turning off. The user can start the percussion mechanism 5 by pressing on the drill once again, i.e. can move it from the resting phase into the chiseling phase (starting phase; FIG. 4).

The pneumatic percussion mechanism 5 comprises an exciter 13, a percussion means 14 and a rivet header 15 in the percussion direction 6. The exciter 13 is forced to move periodically along the working axis 3 by means of the electric motor 8. The percussion means 14 couples to the movement of the exciter 13 by means of an air spring. The air spring is formed by a pneumatic chamber 16 that is enclosed by the exciter 13 and the percussion means 14. The percussion means 14 moves in the percussion direction 6 until the percussion means 14 strikes the rivet header 15. The rivet header 15 rests against the tool 4 in the percussion direction 6 and transmits the blow to the tool 4.

The example percussion mechanism 5 comprises a piston-shaped exciter 13 and a piston-shaped percussion means 14, which are guided along the working axis 3 by a guide tube 17. The exciter 13 and the percussion means 14 rest against the inner surface of the guide tube 17 by means of their lateral surfaces. The pneumatic chamber 16 is enclosed by the exciter 13 and the percussion means 14 along the working axis 3, and by the guide tube 17 in the radial direction. Sealing rings in the lateral surfaces of the exciter 13 and the percussion means 14 can improve the air-tight seal of the pneumatic chamber 16.

The exciter 13 is connected to the electric motor 8 by means of a transmission component. The transmission component transforms the rotary movement of the electric motor 8 into a periodic translational movement along the working axis 3. An example transmission component is a cam gear 18, which is connected to the electric motor 8. An eccentric rod 19 connects a pin 20 of the cam gear 18 to a pin in the exciter 13. The exciter 13 moves in sync with the electric motor 8. The electric motor 8 typically rotates in response to the operating button 12 being pressed down, and rotates for as long as the user presses and holds the operating button 12. The periodic forwards and backwards movement of the exciter 13 likewise begins and ends with the pressing or release of the operating button 12. Another example of such a transmission component is a wobble drive.

The percussion means 14 is coupled to the exciter 13 by means of the air spring. The air spring comprises a pressure difference between the pressure in the pneumatic chamber 16 and the pressure in the surrounding area. The exciter 13, which is forced to move, increases or reduces the pressure in the pneumatic chamber 16 by means of its periodic axial movement. The percussion means 14 is accelerated in or counter to the percussion direction 6 by the pressure difference. FIG. 2 shows, in a split view of the exciter 13 and of the percussion means 14, their position in the compression point (upper half of the image) and in the point of percussion (lower half of the image). In the compression point, the pneumatic chamber 16 is compressed as much as possible, and the pressure difference is therefore as large as possible. The percussion means 14 is closest to the exciter 13. The compression point approximately coincides with the reversal point of the oscillatory movement of the percussion means 14. In the point of percussion, the percussion means 14 strikes the rivet header 15 when the tool 4 is in the working position. The percussion means 14 induces a shock wave in the rivet header 15, which passes through said header and is transmitted to the tool 4 resting against the rivet header 15.

The rivet header 15 is guided in a percussion tube 21 so as to be moveable along the working axis 3. The percussion tube 21 can be formed by the guide tube 17 that guides the exciter 13 and the percussion means 14, or a separate tube. The rivet header 15 is moveable in the percussion tube 21 between a working position (FIG. 2), resting positions (FIG. 3) and a starting position (FIG. 4). In the working position, the rivet header 5 rests against the stop 22 counter to the percussion direction 6. In the chiseling phase, the user presses the drilling hammer 1, in the percussion direction 6, against the tool 4 using the percussion mechanism 5 until the stop 22 rests against the rivet header 15. The working position of the tool 4 is characterized in that the rivet header 15 is in its working position and the tool 4 rests against the rivet header 15. The shock wave induced by the percussion means 14 can pass from the rivet header 15 to the tool 4.

In a resting phase, the user raises the hammer drill 1 from the substrate. The tool 4 and the rivet header 15 can move, in the percussion direction 6, from the working position and into the resting position due to a blow or gravity (FIG. 3). The percussion mechanism 5 is preferably deactivated when the rivet header 15 is in the resting position. The percussion mechanism 5 can comprise exactly one defined resting position, for example when the rivet header 15 rests against a stop 23 in the percussion direction 6. The example percussion mechanism 5 comprises a plurality of resting positions, all of which are within a connected region that is adjacent to the stop 23.

The percussion mechanism 5 can be deactivated by reducing the speed of the electric motor 8. The percussion mechanism 5 is designed for an optimum impact rate, i.e. strikes per second, in which the percussion means 14 and the exciter 13 move synchronously. The optimum impact rate is, inter alia, preset by the mass of the percussion means 14, the end face of the percussion means 14 and the distance from the compression point to the point of percussion. If the periodicity of the exciter 13, which is forced to move, differs significantly from the optimum impact rate, the percussion means 14 can no longer follow the excitation caused by the exciter 13 and remains still. For this purpose, the speed can be reduced with respect to the speed for the optimum impact rate by 20% or more, for example. A sensor can record accelerations of the machine housing 10, impact noises or a position of the percussion means 14 or the rivet header 15, for example, in order to detect the resting position. The speed is reduced in response to the sensor.

The percussion mechanism 5 can be deactivated by decoupling the percussion means 14 from the exciter 13. The pneumatic chamber 16 is ventilated in order to equalize the pressure between the pneumatic chamber 16 and the surrounding area. The exchange of air stops the moving exciter 13 from being able to establish a pressure difference that is sufficient to move the percussion means 14. The chamber is ventilated by one or preferably more radial ventilation openings 24 in the pneumatic chamber 16, which connect the cavity in the pneumatic chamber 16 to the surrounding area. The radial ventilation openings 24 are drilled or punched holes in the guide tube 17, for example. The surrounding area is typically the interior of the machine housing 10, which itself can in turn permanently exchange air with an environment outside the machine housing 10 by means of openings. The volume of the surrounding area is of such a size that the quantity of air moved by the exciter 13 does not cause any considerable fluctuations in pressure. For example, the volume of the surrounding area is at least ten times as large as the maximum volume of the pneumatic chamber 16.

The radial ventilation openings 24 can be sealed and opened by a spool valve 25. The spool valve 25 is composed of the radial ventilation openings 24 and the percussion means 14. The spool valve 25 is closed with respect to the pneumatic chamber 16 when the lateral surface of the percussion means 14 covers the ventilation openings 24 or the percussion means 14 is in front of the ventilation openings 24 in the percussion direction 6 (FIG. 2). The spool valve 25 is open with respect to the pneumatic chamber 16 when the percussion means 14 is behind the ventilation openings 24 in the percussion direction 6 (FIG. 3). The pneumatic chamber 16 then stretches as far as the ventilation openings 24 along the working axis 3. The position of the percussion means 14, in which the spool valve 25 switches from open to closed, and vice versa, is referred to as the switching point of the spool valve 25 in the following (FIG. 4, lower half of the image).

The spool valve 25, i.e. the ventilation openings 24, is arranged along the working axis 3 such that the spool valve 25 is continuously closed during the chiseling phase (FIG. 2), ergo in the working position, and can only be opened during the resting phase (FIG. 3), ergo in the resting position. The ventilation openings 24 are arranged along the working axis 3 so as to be behind the point of percussion in the percussion direction 6. When viewed in the percussion direction 6, the percussion means 14 is located in the point of percussion in front of the switching point. The percussion means 14 covers the ventilation opening 24 with respect to the pneumatic chamber 16 the whole time it is moving between the compression point and the point of percussion. In the resting phase, the percussion means 14 can glide beyond the point of percussion in the percussion direction 6 when the rivet header 15 is moved to a sufficient extent in the percussion direction 6 with respect to the working position. The percussion means 14 no longer covers the ventilation opening 24, i.e. the pneumatic chamber 16 overlaps the ventilation opening 24. A cross section of the ventilation openings is selected such that a flow of air between the pneumatic chamber 16 and the surrounding area equalizes the rate of change of the volume of the pneumatic chamber 16 due to the exciter 13 that is moved. The pressure in the pneumatic chamber 16 only slightly differs from that of the surrounding area, which is why a considerable amount of force is not exerted on the percussion means 14. The percussion mechanism 5 is deactivated despite the exciter 13 continuing to move. The collective cross-sectional area of the ventilation openings 24 is in the range of from 2% to 6% of the cross-sectional area of the pneumatic chamber 16, i.e. the end face of the exciter 13.

The percussion means 14 and the rivet header 15 can enclose an (intermediate) chamber 26 along the working axis 3. The guide tube 17 and the percussion tube 21 surround the intermediate chamber 26.

A channel 27 connects the pneumatic chamber 16 and the intermediate chamber 26. The channel 27 allows for air to be exchanged between the pneumatic chamber 16 and the intermediate chamber 26 in a controlled manner. The channel 27 is provided with a shut-off valve 28 and a check valve 29. The shut-off valve 28 and the check valve 29 only allow air to flow into the pneumatic chamber 16 and only when the rivet header 15 has been moved out of the working position. At least one of the two valves blocks air from flowing into anywhere else.

The channel 27 comprises one, preferably several, channel openings 30 that extend into the pneumatic chamber 16. The channel openings 30 are preferably radial openings in the pneumatic chamber 16, for example a drilled or punched hole in the guide tube 17. The (first) channel opening 30 is preferably on or near the percussion means-side reversal point of the exciter 13. The channel opening 30 is not covered by the exciter 13 or by the percussion means 14 for very long. Alternatively, the channel opening 30 can be arranged at a different point along the guide tube 17, provided that the pneumatic chamber 16 overlaps the channel opening 30, at least temporarily, during the chiseling phase. The other (second) channel opening 31 extends into the intermediate chamber 26, for example. The channel 27 and the channel openings 30 have a cross-sectional area through which air can flow of from 0.5% to 4% of the cross-sectional area of the pneumatic chamber 16, i.e. the end face of the exciter 13.

The shut-off valve 28 is actuated by the rivet header 15. The shut-off valve 28 is closed when the rivet header 15 is in the working position (FIG. 2). The shut-off valve 28 is open when the rivet header 15 is moved out of the working position (FIG. 3). The position of the rivet header 15, in which the shut-off valve 28 switches from open to closed, and vice versa, is referred to as the switching point of the shut-off valve 28 in the following (FIG. 4, upper half of the image). When viewed in the percussion direction 6, the rivet header 15 is located in the switching point behind the working position.

The switching point of the spool valve 25 and the switching point of the shut-off valve 28 are preferably adapted so as to match. The position of the rivet header 15 predetermines whether or not the percussion means 14 can open the spool valve 25. If the rivet header 15 is in the switching point of the shut-off valve 28, the spool valve 25 is closed (FIG. 4, upper half of the image). When in the switching point of the shut-off valve 28, the rivet header 15 protrudes counter to the percussion direction 6 to such an extent that the percussion means 14, which rests against the rivet header 15, is in front of the switching point of the spool valve 25 in the percussion direction 6, i.e. covers the ventilation opening 24. The percussion mechanism 5 comprises a starting position (FIG. 4, lower half of the image), in which the percussion means 14 is in the switching point of the spool valve 25 and the rivet header 15 touches the percussion means 14. In the starting position, the rivet header 15 is displaced with respect to the switching point of the shut-off valve 28 by a distance 32 in the percussion direction 6.

The check valve 29 is connected to the intermediate chamber 26 on the input side, and to the pneumatic chamber 16 on the output side. Accordingly, the check valve 29 allows a flow of air to pass from the intermediate chamber 26 and into the pneumatic chamber 16, and blocks a flow of air from passing from the pneumatic chamber 16 into the intermediate chamber 26.

When positioning a hammer drill 1 and the tool 4 on a substrate, the rivet header 15 is pushed, counter to the percussion direction 6, out of a resting position, into the starting position and lastly into the working position. In the resting position, the spool valve 25 and the shut-off valve 28 are open. In the starting position, the spool valve 25 closes and the shut-off valve 28 is open. In the working position, the spool valve 25 is closed and the shut-off valve 28 is closed. Between the starting position and the working position, the spool valve 25 is closed and the shut-off valve 28 is open. The region between the starting position and the working position is referred to as the starting region in the following.

The quantity of air (air mass) in the pneumatic chamber 16 increases when the rivet header 15 is in the starting region. The increased quantity of air leads to a higher average pressure in the pneumatic chamber 16. The quantity of air reduces when the rivet header 15 switches to the resting position or the working position.

During a starting phase, the percussion mechanism 5 continuously transitions from the resting phase to the chiseling phase with full percussive power. When pressing the hammer drill 1, the user can feel the pressure in the pneumatic chamber 16 increase as soon as the rivet header 15 has reached the starting region. The user has to apply a minimum force in order to overcome the pressure, otherwise the percussion means 14 moves the rivet header 15 beyond the starting position and switches off the percussion mechanism 5 by means of the spool valve 25.

The channel 27 comprising the shut-off valve 28 and the check valve 29 leads to an overpressure in the pneumatic chamber 16 when the rivet header 15 is in the starting region. The check valve 29 only allows air to flow into the pneumatic chamber 16. The exciter 13 sucks air in through the opening check valve 29 as it moves counter to the percussion direction 6. The quantity of air in the pneumatic chamber 16 increases since air cannot flow out. Leakages restrict an increase in the quantity of air. The pressure in the pneumatic chamber 16 is greater than in the intermediate chamber 26, a force is accordingly produced in the percussion direction 6 that acts on the percussion means 14 and indirectly on the rivet header 15 resting against the percussion means 14. The user can feel the counterforce acting on the exciter 13 and the handle 11 counter to the percussion direction 6.

If the rivet header 15 is in the working position, air stops being sucked in as a result of the shut-off valve 28 closing. The increased quantity of air in the pneumatic chamber 16 is slowly discharged via a throttle opening 33 in the pneumatic chamber 16. The throttle opening 33 is preferably arranged on or near the percussion means-side reversal point of the exciter 13. A cross-sectional area of the throttle opening 33 is very small. The cross section preferably restricts the exchange of air with the surrounding area to less than 1/10 of the quantity of air in the pneumatic chamber 16 within one cycle of the exciter 13. The cross-sectional area of the throttle opening 33 is in the range of from 0.05% to 0.20% of the end face of the exciter 13. The quantity of air in the pneumatic chamber 16 equates to that of the surrounding area within from ten to fifty cycles of the exciter 13. In this case, between 500 milliseconds (ms) and 800 ms pass, for example, depending on the size of the percussion mechanism 5. The throttle opening 33, of which there is preferably only one, is in particular considerably smaller than the ventilation openings 24 and the channel opening 30. The cross-sectional area of the throttle opening 33 is preferably less than 6% of the cross-sectional area of the ventilation opening 24 and preferably less than 8% of the cross-sectional area of the channel opening 30. For example, the channel 27 has four first channel openings 30 each having a cross-sectional area of 2 mm2 and the cross-sectional area of the throttle opening 33 is 0.5 mm2.

After being switched off, the percussion means 14 can unintentionally close the spool valve 25, for example due to vibrations. Provided that the rivet header 15 is not accidentally in the working position, the pump effect causes an average amount of force to be placed on the percussion means 14 in the percussion direction 6. The percussion means 14 is pushed into the resting position, the spool valve 25 is opened and the percussion mechanism 5 is switched off.

Figure 5:
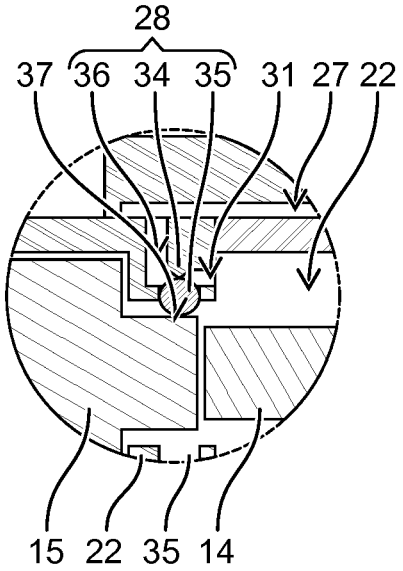
FIG. 5 shows a shut-off valve of the percussion mechanism.

The example shut-off valve 28 comprises a stationary valve seat 34 and a resilient shut-off body 35 in a valve channel 36 (FIG. 5). The valve channel 36 opens up into the second channel opening 31. The shut-off valve 28 is closed when the shut-off body 35 fully rests against the valve seat 34 and constricts the valve channel 36 as a result. The shut-off body 35 is resiliently tensioned when the shut-off body 35 fully rests against the valve seat 34. The shut-off valve 28 is a self-opening valve. Without any external force, the shut-off body 35 relaxes from the tensioned form into a basic form, which does not rest against the valve seat 34 or only rests thereagainst in part. The shut-off valve 28 is switched by means of the rivet header 15. The rivet header 15 comprises an effective surface 37, which actuates the shut-off body 35. The effective surface 37 forces the shut-off body 35 against the valve seat 34 when the rivet header 15 is in the working position. If the rivet header 15 is behind the switching point in the percussion direction 6, no force is applied to the effective surface 37 and said surface is not in contact with the shut-off body 35.

The example shut-off body 35 is a resilient ring, for example made of rubber. The shut-off body 35 is arranged coaxially with the working axis 3 inside the strike tube 21. The example valve seat 34 points towards the working axis 3 in the radial direction and lies in one plane together with the shut-off body 35. The distance between the valve seat 34 and the working axis 3 is slightly greater than the external radius of the resilient ring. In the basic form, a gap is formed between the ring and the valve seat 34. The effective surface 37 of the rivet header 15 is a portion of the cylindrical lateral surface. The radius of the lateral surface is greater than an internal radius of the ring at least by the size of the gap. The effective surface 37 is inside the plane when the rivet header 15 is in the working position. The effective surface 37 spreads the ring apart such that the ring fully touches the valve seat 34. If the rivet header 15 is outside the working position, the ring contracts in the radial direction into its basic form and releases itself from the valve seat 34.

The check valve 29 is arranged on or near the first channel opening 30 such that it cannot move. The channel portion from the first channel opening 30 to the check valve 29 is as short as possible. A dead volume formed by the channel portion is preferably constant and less than 5% of the average volume of the pneumatic chamber 16.

Figure 6:
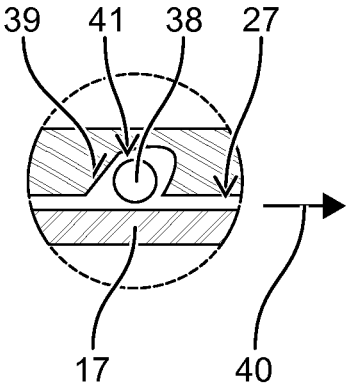
FIG. 6 shows a check valve of the percussion mechanism.

The example check valve 29 comprises a moveable shut-off body 38 and an inclined guide surface 39 (FIG. 6). The check valve 29 comprises a forward direction 40, in which a flow of air can flow through the check valve 29. The check valve 29 automatically blocks air flowing counter to the forward direction 40. On the input side, i.e. in front of the check valve 29 in the forward direction 40, the shut-off valve 28 is arranged; on the output side, i.e. downstream of the check valve 29 in the forward direction 40, the pneumatic chamber 16 is arranged. The movable shut-off body 35 lies in a bulge 41 in the channel 27. The bulge 41 comprises a dimension along the forward direction 40 that allows the shut-off body 38 to move in the forward direction 40. On the input side, the inclined guide surface 39 is provided on the bulge 41. The guide surface 39 moves towards the channel 27 counter to the forward direction 40, causing the shut-off body 35, which is pressed against the guide surface 39 by air flowing counter to the forward direction 40, is pressed into the channel 27. The movable shut-off body 35 can be a ball or a resilient ring that encompasses the guide tube 17.

Figure 7:
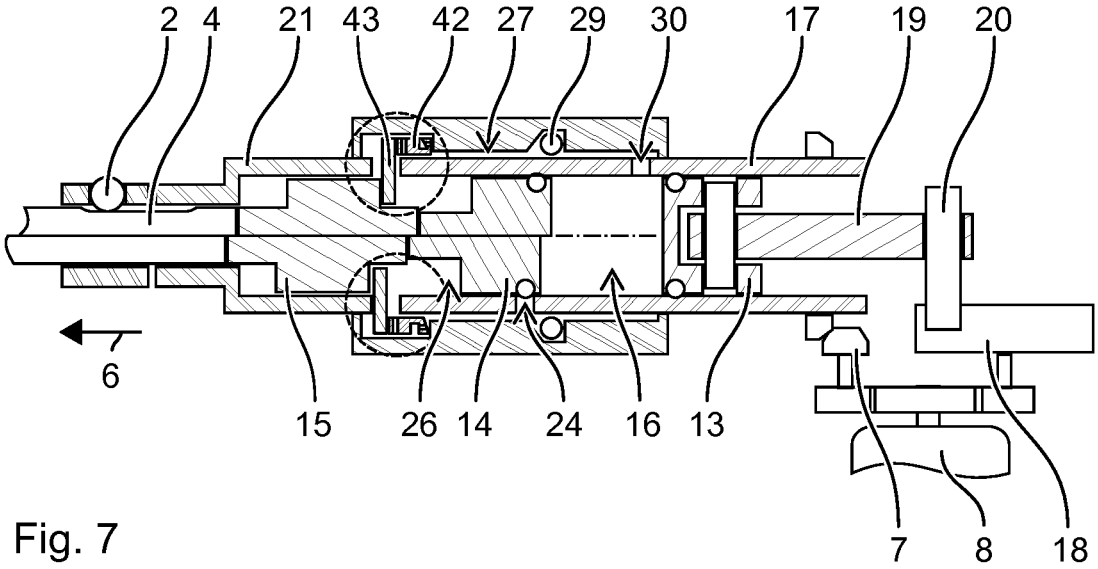
FIG. 7 shows a percussion mechanism in a starting phase.
Figure 8:
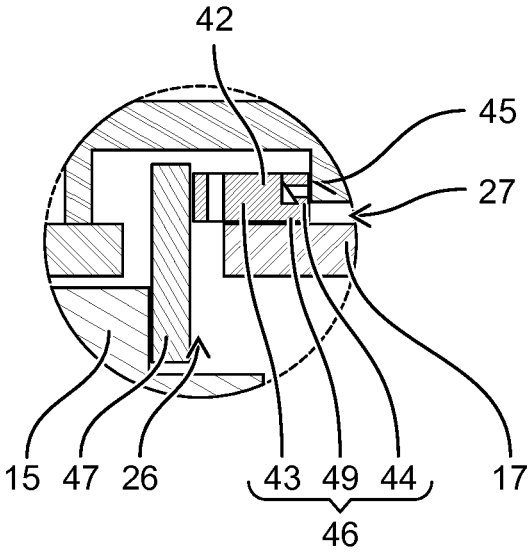
FIG. 8 shows a shut-off valve of the percussion mechanism in the closed position.
Figure 9:
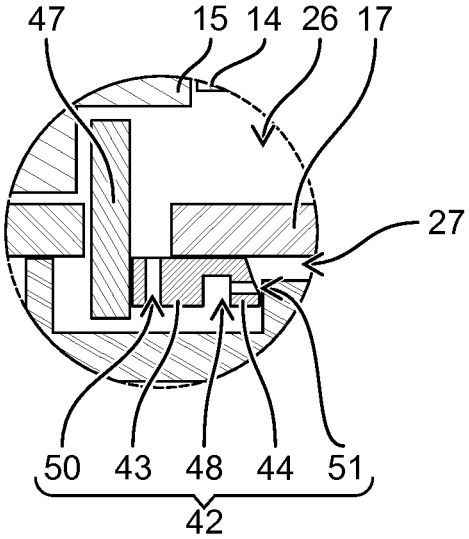
FIG. 9 shows the shut-off valve in the open position.

FIGS. 7, 8 and 9 show one embodiment of the shut-off valve 42. The shut-off valve 28 is actuated by the rivet header 15. The rivet header 15 closes the shut-off valve 28 when the rivet header 15 is in the working position (FIG. 7, upper half of the image; FIG. 8). The shut-off valve 28 is open when the rivet header 15 is moved out of the working position (FIG. 8, bottom half of the image; FIG. 9).

The shut-off valve 42 comprises a valve seat 43 and a resilient shut-off body 44. The valve seat 45 and the shut-off body 46 are formed from a monolithic resilient ring 46. The ring 46 is arranged coaxially with the rivet header 15. For example, the ring 46 is placed on the guide tube 17. Alternatively, the ring 46 can be arranged inside the guide tube 17, between the percussion means 14 and the rivet header 15. The ring 46 is clamped between the rivet header 15 and a seat 45 along the working axis 3. When in the working position, the rivet header 15 presses on the ring 46 counter to the percussion direction 6. In the example embodiment, an actuation spool 47 transmits the force from the rivet header 15 to the ring 46. The seat 45 cannot move relative to the guide tube 17, and therefore the pressing force exerted by the rivet header 15 can axially compress the ring 46. The seat 45 forms the stop together with the ring 46, against which the rivet header 15 is pressed counter to the percussion direction 6 for the working position.

The ring 46 comprises a circumferential notch 48, which divides the ring 46 along the axis into the valve seat 43 and the shut-off body 44. The shut-off body 44 can be in the form of a thin lip. The shut-off body 44 can be pivoted into the notch 48 to such an extent that the shut-off body 44 touches the valve seat 43 and seals the notch 48 (FIG. 8). The ring 46, in particular the lip-shaped shut-off body 44 and a connecting piece 49 that connects the shut-off body 35 to the valve seat 43, are resiliently tensioned when the shut-off body 44 is resting against the valve seat 43. In the relaxed basic form of the ring 46, the notch 48 is open, i.e. the shut-off body 44 is at a spacing from the valve seat 43 (FIG. 9).

The ring 46 comprises one or more radial cuts 50 in the valve seat 43 and an axial cut 51 in the shut-off body 44. The air can flow out of the intermediate chamber 26, through the radial cut 50 to the side comprising the notch 48, into the notch 48 and through the axial cut 51, out of the shut-off valve 42 and into the channel 27. The airflow is interrupted when the notch 48 is compressed, i.e. the lip-shaped shut-off body 44 is resting against the valve seat 43. In the example shut-off valve 42, the ring 46 rests against the guide tube 17 in an air-tight manner by means of its radially inner surface, and the notch 48 is on the radial outside. Alternatively, the ring 46 can be arranged with the lip-shaped shut-off body in the percussion direction 6 and the valve seat resting against the seat. The ring 46 is made of rubber or a synthetic rubber, for example.

The invention claimed is:

1. A hand-held percussion power tool, comprising:

a tool holder for holding a percussion tool on a working axis;

an electric motor;

a percussion mechanism, comprising an exciter piston that is moved by the electric motor, a percussion piston, which is coupled to the exciter piston by a pneumatic chamber arranged between the exciter piston and the percussion piston, the pneumatic chamber comprising a first radial opening and a second radial opening; and a rivet header that is arranged in front of the percussion piston in a percussion direction, wherein, when in a working position, the rivet header rests against a stop counter to the percussion direction, when in a starting position, the rivet header is moved in the percussion direction into the working position, and, when in a resting position, the rivet header is moved in the percussion direction into the starting position;

a spool valve that is formed by the first radial opening in the pneumatic chamber and the percussion piston, wherein, in the starting position, the percussion piston that is resting against the rivet header closes the spool valve and, in the resting position, the percussion piston that is resting against the rivet header opens the spool valve;

a shut-off valve, comprising an input side and an output side, wherein the shut-off valve is closed in the working position as actuated by the rivet header, and automatically opens in the starting position, wherein the shut-off valve comprises a valve seat and a resilient shut-off body, which, in a relaxed form, is at a spacing from the valve seat, and is deformed by the rivet header that is in the working position so as to rest against the valve seat in a resilient tensioned manner;

and, a check valve, which is connected to the shut-off valve on the input side and is connected to the second radial opening in the pneumatic chamber on the output side.

2. The hand-held power tool according to claim 1, wherein the pneumatic chamber comprises a throttle opening for exchanging air between the pneumatic chamber and an area around the hand-held power tool.

3. The hand-held power tool according to claim 2, wherein the throttle opening is arranged on a percussion piston-side reversal point of the exciter piston.

4. The hand-held power tool according to claim 3, wherein a ratio of a cross-sectional area of the throttle opening to a cross-sectional area of the second radial opening is less than one to twelve.

5. The hand-held power tool according to claim 2, wherein a ratio of a cross-sectional area of the throttle opening to a cross-sectional area of the second radial opening is less than one to twelve.

6. The hand-held power tool according to claim 1, wherein the pneumatic chamber comprises a throttle opening for exchanging air between the pneumatic chamber and an area around the hand-held power tool.

7. The hand-held power tool according to claim 6, wherein a ratio of a cross-sectional area of the throttle opening to a cross-sectional area of the second radial opening is less than one to twelve.

8. The hand-held power tool according to claim 6, wherein the throttle opening is arranged on a percussion piston-side reversal point of the exciter piston.

9. The hand-held power tool according to claim 8, wherein a ratio of a cross-sectional area of the throttle opening to a cross-sectional area of the second radial opening is less than one to twelve.

10. The hand-held power tool according to claim 1, wherein the throttle opening is arranged on a percussion piston-side reversal point of the exciter piston.

11. A hand-held percussion power tool, comprising:

a tool holder for holding a percussion tool on a working axis;

an electric motor;

a percussion mechanism, comprising an exciter piston that is moved by the electric motor, a percussion piston, which is coupled to the exciter piston by a pneumatic chamber arranged between the exciter piston and the percussion piston, the pneumatic chamber comprising a first radial opening and a second radial opening; and a rivet header that is arranged in front of the percussion piston in a percussion direction, wherein, when in a working position, the rivet header rests against a stop counter to the percussion direction, when in a starting position, the rivet header is moved in the percussion direction into the working position, and, when in a resting position, the rivet header is moved in the percussion direction into the starting position;

a spool valve that is formed by the first radial opening in the pneumatic chamber and the percussion piston, wherein, in the starting position, the percussion piston that is resting against the rivet header closes the spool valve and, in the resting position, the percussion piston that is resting against the rivet header opens the spool valve, wherein the spool valve is closed with respect to the pneumatic chamber by the percussion piston that is resting against the rivet header that is in the working position, and the spool valve is opened with respect to the pneumatic chamber by the percussion piston, which is resting against the rivet header that is in front of the working position in the percussion direction;

a shut-off valve, comprising an input side and an output side, wherein the shut-off valve is closed in the working position as actuated by the rivet header, and automatically opens in the starting position, wherein the shut-off valve comprises a valve seat and a resilient shut-off body, which, in a relaxed form, is at a spacing from the valve seat, and is deformed by the rivet header that is in the working position so as to rest against the valve seat in a resilient tensioned manner; and, a check valve, which is connected to the shut-off valve on the input side and is connected to the second radial opening in the pneumatic chamber on the output side.

12. The hand-held power tool according to claim 2, wherein the pneumatic chamber comprises a throttle opening for exchanging air between the pneumatic chamber and an area around the hand-held power tool.

13. The hand-held power tool according to claim 12, wherein a ratio of a cross-sectional area of the throttle opening to a cross-sectional area of the second radial opening is less than one to twelve.

14. The hand-held power tool according to claim 12, wherein the throttle opening is arranged on a percussion piston-side reversal point of the exciter piston.

15. The hand-held power tool according to claim 14, wherein a ratio of a cross-sectional area of the throttle opening to a cross-sectional area of the second radial opening is less than one to twelve.

16. The hand-held power tool according to claim 2, wherein the throttle opening is arranged on a percussion piston-side reversal point of the exciter piston.

* * * * *